US005141528A

United States Patent [19]

Boczkiewicz et al.

[11] Patent Number: 5,141,528

[45] Date of Patent: Aug. 25, 1992

[54] SEPARATOR DOCKING SYSTEM

[75] Inventors: Bruce M. Boczkiewicz, Mukwonago; Jeffrey T. Seawell, Waukesha, both of Wis.

[73] Assignee: Super Products Corporation, New Berlin, Wis.

[21] Appl. No.: 676,390

[22] Filed: Mar. 27, 1991

[51] Int. Cl.[5] ..... B01D 45/12

[52] U.S. Cl. ..... 55/1; 55/356; 55/459.1; 280/504; 280/515; 280/416.3; 15/340.1

[58] Field of Search ..... 55/1, 356, 357, 459.1, 55/345, 349; 15/340.1; 280/504, 515, 416.1, 416.2, 416.3; 403/322, 321; 414/401, 402, 396; 172/272-274

[56] References Cited

U.S. PATENT DOCUMENTS

| | | | |
|---|---|---|---|
| 1,453,059 | 4/1923 | Blass | 280/504 |
| 2,703,733 | 3/1955 | Stueven | 55/356 |
| 2,940,776 | 6/1960 | Curtis | 280/504 |
| 3,973,935 | 8/1976 | Moore, Jr. et al. | 55/302 |
| 4,349,211 | 9/1982 | Cooper | 280/505 |
| 4,963,172 | 10/1990 | Demarco | 55/356 |
| 5,030,259 | 7/1991 | Bryant et al. | 55/356 |

FOREIGN PATENT DOCUMENTS 3726823 12/1988 Fed. Rep. of Germany .

OTHER PUBLICATIONS

XCR Series Guzzler Vacuum Loader, Brochure, Guzzler Manufacturing, Inc. 1990.

*Primary Examiner*—Bernard Nozick

*Attorney, Agent, or Firm*—Foley & Lardner

[57] ABSTRACT

A separator, for example of the type used for the separation of hazardous materials, is docked to an industrial vacuum source, such as a truck mounted industrial vacuum loader, utilizing a docking system adapted to provide ease of attachment and separation. The docking system allows rotational and elevational control of the separator and provides retrofit capability for existing systems. Furthermore, by using the readily detachable separator described in the present specification, a single separator may be used with a variety of trucks, thereby increasing overall fleet efficiency.

23 Claims, 4 Drawing Sheets

SEPARATOR DOCKING SYSTEM

BACKGROUND OF THE INVENTION

1. Field of the Invention

The present invention relates generally to industrial vacuum cleaning machines and, more particularly, to cleaning devices which include a separator, usually of the centrifugal variety, in combination with an industrial vacuum loader of a type previously known to the art. Still more specifically, the present invention relates to a combination separator and industrial vacuum loading truck, where the separator may be readily detached from and connected to the truck using a unique docking bracket attached to separator rotational and elevational coupling arms.

2. Description of the Related Art

It has been known for many years that vacuum devices can be mounted on truck bodies, resulting in industrial vacuum loaders which have a wide variety of applications. The importance of this technology has increased substantially over the last two decades and will continue to increase as the need to recycle and handle hazardous materials increases.

In a typical vacuum loader, such as that sold previously by the assignee of the present invention, a truck body is provided for collection and containment of material to be collected through an inlet conduit, e.g., a flexible collection hose. A powerful vacuum pump is provided, usually of the positive displacement variety, to draw a vacuum in the truck body, thereby causing a high velocity air flow through the inlet hose. The truck body will act as a primary separation area, so that the material collected through the hose drops to the bottom of the body. Air flowing between the body and the pump is filtered to prevent pump damage, using such devices as bag filters or cyclone type separators. Suitable body dumping devices may also be employed to remove collected material. A typical vacuum loader is shown in U.S. Pat. No. 3,973,935 issued to the assignee of the present invention on Aug. 10, 1976 and entitled "Dust Filtration System".

In recent years it has become increasingly common to use such equipment for the collection or removal of materials on site, and several particularly noteworthy uses of such equipment have been in the collection of crude oil following oil spills and the removal of hazardous materials from contaminated sites. In such cases, it is preferable not to contaminate the truck body, but to use a distinct separator for intercepting the contaminated material, while still using the vacuum capabilities of the remainder of the existing system. One device designed for such application is manufactured by Guzzler Manufacturing, Inc. of Birmingham, Ala. In this device, a centrifugal separator may be selectively coupled to a vacuum flow path for separation of hazardous materials. The separator includes a pair of sliding gate valves, whereby material collected in the separator may be periodically dropped into a hopper at the bottom of the separator by opening the upper one of the pair of valves. After the top valve is closed, the bottom valve is opened to discharge collected material into a suitable receptacle, such as a truck body or drum. The Guzzler system includes actuators for raising and lowering the separator to provide for different discharge heights and the capability of pivoting the separator outwardly from the truck body for positioning of the discharge opening at a selected location. A brochure entitled "XCR Series Guzzler Vacuum Loader", showing a copyright date of 1990, is attached to this specification and illustrates such system.

Several problems are encountered in connection with such cyclone separation systems, such as that employed by Guzzler Manufacturing, Inc. For instance, the cyclone is always attached to the truck and adds substantially to the loader's cost. Such cost can only be justified during operations involving use of the separator, since at other times the separator is not put to any practical use. In the Guzzler system the air exhaust from the cyclone goes directly to the filtration system used to protect the vacuum pump, and does not go through the body. In the event that the cyclone overfills, for example through overly aggressive collection by an operator, the filtration units could be rapidly clogged. This is a disadvantage resulting from placement of the separator between the body and the filter.

Other disadvantages of the Guzzler system include the fact that its standard 6-inch inlets restrict air flow, even when the separator system is not being used, (i.e. when the unit is being used for normal collection operations). Finally, being permanently attached to the vacuum system, the Guzzler system is difficult to decontaminate.

A separator system which would overcome the aforementioned disadvantages would represent a substantial advance in this art.

SUMMARY OF THE INVENTION

The present invention features a separator system which is easily and quickly connected to and disconnected from a truck and which provides full manipulative capabilities. A feature of the invention is a unique docking system which allows attachment to a vacuum loader without the use of tools. Another feature is the fact that the separator docking system can be retrofitted to existing trucks merely by adding a suitable mounting bracket to the truck. In such event, one separator could be used with many trucks to increase fleet efficiency.

Other features of the invention include providing a separator which can be placed on the ground for use at remote locations, and so that the separator can be used with vacuum systems other than that provided with the vacuum truck. Another feature includes the provision of a high level alarm to help pace the operator vacuuming debris through the separator, and the ability to use the body or bag house of the truck for separator carryover. Moreover, when not in use, the full vacuum capabilities, unrestricted by hose sizing is achieved. Due to the fact that the separator is portable and detachable, another advantageous feature is its ease of decontamination.

How the aforementioned features of the invention are accomplished will be described in the following detailed description of a preferred embodiment, taken in connection with the FIGURES. Generally, however, they are provided in a device which includes a cyclone separator including a pair of gate valves to permit periodic discharge of material collected in the separator. The separator is mounted by a pair of arms which include suitable hydraulic or pneumatic actuators to permit the separator to be vertically and rotationally adjusted with respect to its mounting on a vacuum truck.

After the separator's hydraulic or pneumatic control lines, along with any necessary electrical lines, are coupled to the truck, the mounting fixture of the separator interacts with a receiving bracket, preferably located on the rear of the truck body. By suitable activation of the actuators and by proper positioning of the truck, the fixture and bracket dock with one another. A cone on the bracket guides a hole in the upper plate of the separator mounting fixture to facilitate proper alignment of the two components with one another.

Other ways in which the features of the invention described above are accomplished will appear to one skilled in the art after reading the present specification. Such other ways of accomplishing the features are deemed to fall within the scope of the present invention if they fall within the scope of the claims which follow the detailed description of the preferred embodiment.

BRIEF DESCRIPTION OF THE DRAWINGS

In the various drawings, like reference numerals are used to represent like components.

DETAILED DESCRIPTION OF THE PREFERRED EMBODIMENTS

Figure 1:
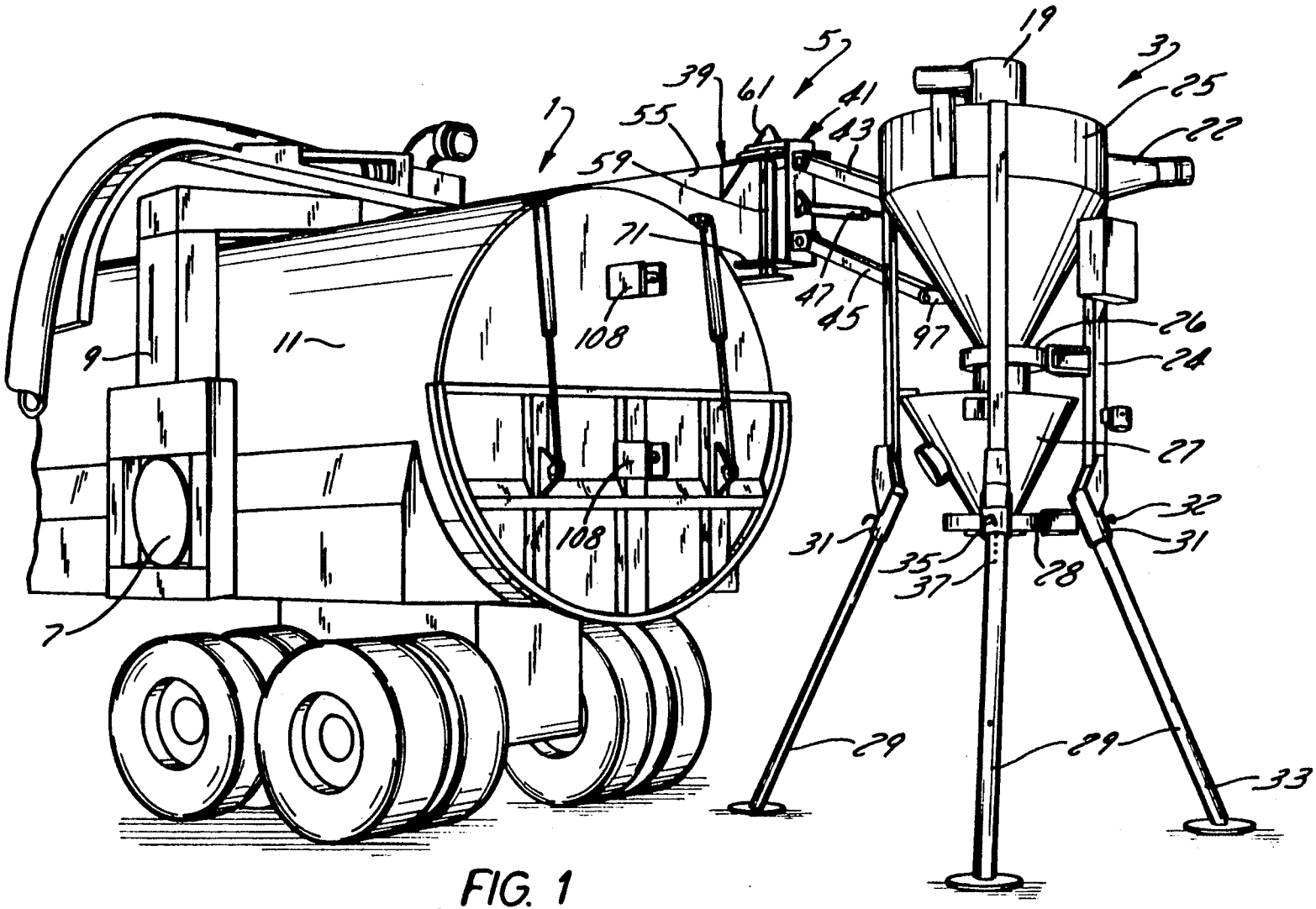
FIG. 1 is a perspective view of a vacuum loading machine which is docked to a separator.
Figure 2:
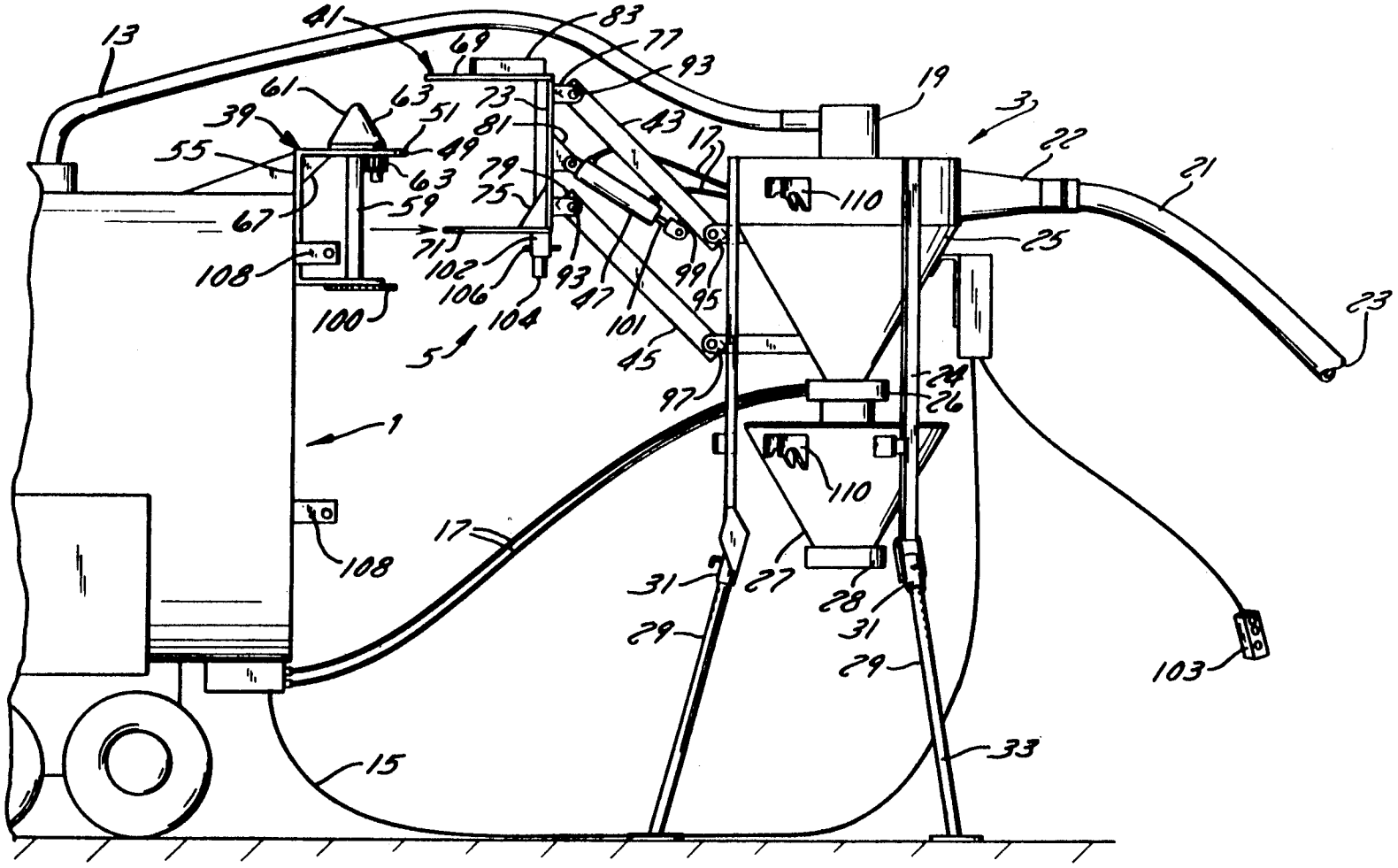
FIG. 2 is a side view, the vacuum loading machine being schematically displayed and the separator being shown in a detached mode.

Referring to FIGS. 1 and 2, a vacuum loading machine 1 (for example a truck mounted loader) may be connected to a separator 3 via a docking assembly 5. The vacuum machine 1 has a vacuum pump 7 coupled to a filtering system 9. Filtering system 9 is coupled to a body 11 which has a vacuum hose 13 extending from it. In normal operation, the vacuum pump 7 creates a vacuum, sucking air and debris through vacuum hose 13. As the air and entrained material enters body 11, the debris falls to the floor of body 11 while the air is filtered through filtering system 9 and subsequently exhausted.

Separator 3 is provided with electrical power from vacuum machine 1 via electrical cable 15. Additionally, either hydraulic or pneumatic power is provided to separator 3 via control lines 17, usually with quick-coupled fittings.

In the illustrated embodiment, the vacuum hose is not used in the normal collection procedure, but is attached to an exhaust port 19 of separator 3. A separate hose 21 is connected to the inlet port 22 of separator 3 and has a free end 23 through which debris is vacuumed and subsequently separated and collected in separator 3. In the preferred arrangement, hoses 13 and 21 are flexible.

Separator 3 includes a frame 24, an upper hopper 25 in which the collected debris is centrifugally separated, a lower hopper 27 which periodically receives the debris which is separated in the upper hopper 25 through opening of a gate valve 26. Removal of the collected material from hopper 27 is facilitated by the opening of a valve 28 in the bottom of hopper 27. The operation of the separator and its valves will not be described in detail, because in and of themselves, these features do not form part of the present invention.

Separator 3, in the illustrated embodiment, is supported on three adjustable legs 29. The adjustable legs each include a socket 31 on the lower part of frame 34 and a lower shaft portion 33. The lower portions 33 fit within the sockets 31 when it is desired to rest separator 3 on the ground. The lower portions 33 can slide within the sockets 31 to adjust the height of the legs 29, the latter being secured in place by pins 32 which extends through holes 35 located in the socket and into holes 37 located in the upper part of shafts 33 of the leg 29. Other support structures could be substituted for the illustrated system.

Referring to FIG. 2, docking assembly 5 includes a receiving bracket 39 which is fixedly mounted to vacuum machine 1. The separator components of the docking assembly include a mounting fixture 41, arms 43 and 45 which couple mounting fixture 41 to separator 3, and an actuator 47 (which can be pneumatic, hydraulic or electrical) and which is connected at one end to mounting fixture 41 and at the end to arm 43 nearest separator frame 24.

Figure 3:
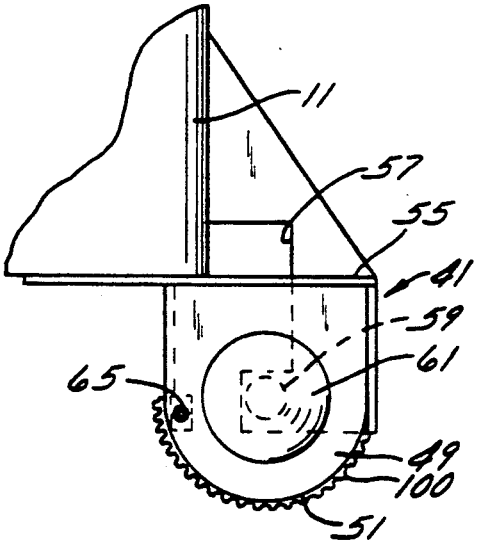
FIG. 3 is a top view of the docking system receiving bracket.

As illustrated in FIGS. 2 and 3, receiving bracket 39 includes an upper plate 49, with an outwardly directed curved edge 51, and a lower plate 53 which is spaced apart and parallel to plate 49. Both plates are rigidly connected to rear plate 55. Rear plate 55 has a curved portion (not shown) which is designed to conform to body 11. Lower plate 53 is substantially rectangular but has a step portion 57 which is also designed to conform to body 11.

Figure 5:
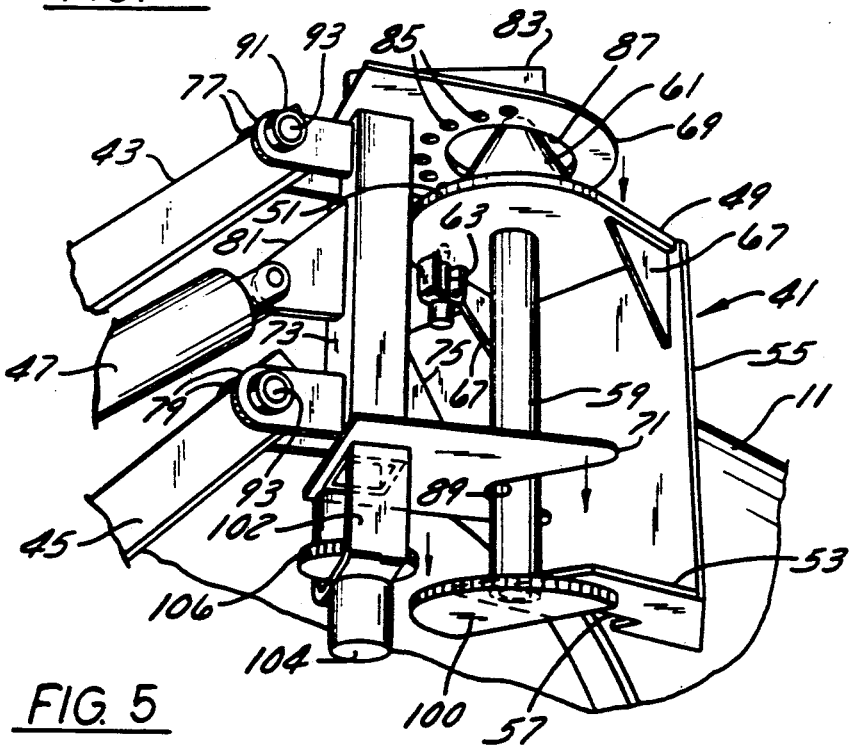
FIG. 5 is a more detailed perspective view of the docking system before coupling.

A cylindrical tube 59 is vertically connected to plates 49 and 53. Tube 59 includes a cone portion 61 at its upper end projecting through and connected to plate 49. A spring-loaded pin 63 is attached to the underside of plate 49 and is designed to project through hole 65 in plate 49 to engage another hole in mounting fixture 41 as will be described in more detail below. If a hydraulic system is used to adjust the rotational orientation of the mounting fixture, the pin 63 could be eliminated. In addition, a pair of gusset plates 67 (see FIG. 5), of which one is shown, are connected between rear plate 55 and upper plate 49 to provide additional strength to plate 49.

Figure 4:
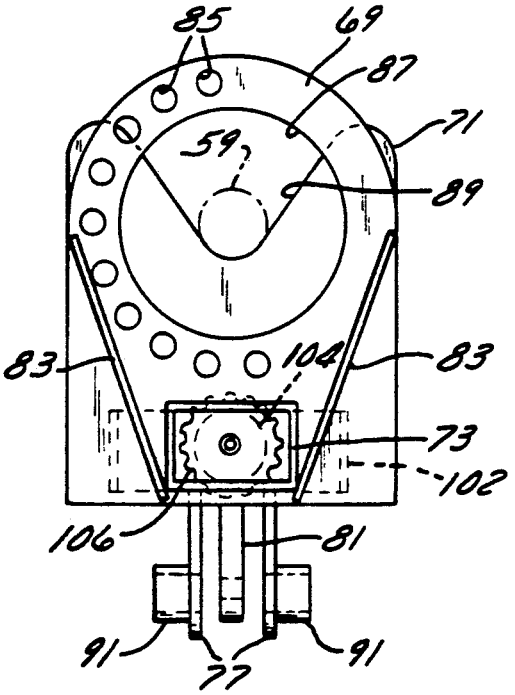
FIG. 4 is a top view of the separator docking system mounting fixture.

Referring to FIGS. 2 and 4, mounting fixture 41 includes a top plate 69 which is spaced apart from and parallel to a bottom plate 71. Plates 69 and 71 are rigidly connected to each other via a rectangular tubal member 73. A gusset plate 75 is rigidly attached to tubal member 73 and to the bottom plate 71 providing additional strength to these members. A pair of upper pivoting ears 77 and a pair of lower pivoting ears 79 are connected to tubal member 73. In addition, an actuator pivoting ear 81 is located between the upper and lower pairs of pivoting ears and is mounted to tubal member 73.

Referring to FIG. 4, two flat stiffeners 83, are mounted on the upper surface of top plate 69. Additionally, a series of holes 85 extend along the outer portion of the perimeter of top plate 69 and are designed to selectively align with hole 65 and engage with pin 63. In addition, top plate 69 has a circular opening 87 which is designed to allow cone 61 to pass through it. Bottom plate 71, on the other hand, has a curved portion 89 which is designed to conform to tube 59. A retainer 91, is mounted on the outer surface of the upper and lower pivoting ears 77, 79 and is designed to receive a pin 93 which extends through each pair of pivoting ears. The pin 93 is locked in place by a bolt (not shown).

As illustrated in FIG. 2, arm 43 has a bushing (not shown) extending through one end and through which pin 93 is disposed coupling arm 43 to the upper pivoting ears 77. Arm 43 is then rotatably mounted about the longitudinal axis of pin 93. The opposite end of arm 43 is coupled to a pair of upper pivoting ears 95, of which one is shown, which are fixedly connected to separator frame 24. Furthermore, the ends of arm 45 are connected in the same manner to the lower pivoting ears 79 and to a second pair of lower pivoting ears 97 which are connected to separator frame 24. In each case, the ends of arms 43, 45 fit between the respective pairs of pivoting ears.

A second actuator pivoting ear 99 is attached to arm 43. Actuator 47 is rotatably connected to actuator pivoting ear 81, while the piston 101 of actuator 47 is rotatably connected to actuator pivoting ear 99.

Power rotation of separator 3 about the axis of cone 61 and tube 59 is provided in the present invention by securing a gear plate 100 to the bottom of plate 53, plate 100 being semicircular in shape and having its curved edge being oriented generally rearwardly with respect to truck loader 1. A bracket 102 is affixed to the lower surface of plate 71 of mounting assembly 41 which in turn supports a motor 104 having a shaft (not shown) coupled to a circular gear 106. When fully docked, the gear 106 meshes with the teeth of plate 100 and activation of motor 100 will cause the desired rotation. Once the desired position is achieved, locking occurs using the pin 63 and holes 85 as previously discussed.

In operation, the docking system, which provides a method for coupling and uncoupling separator 3 from vacuum machine 1, is utilized as follows. First, the hydraulic or pneumatic pressure lines 17 and the electrical lines 15 are coupled to the separator system. The pressure supplied to actuator 47 is decreased via control lines 17. As actuator piston 101 retracts, arms 43 and 45 rotate about pivoting ears 95 and 97 respectively, moving mounting fixture 41 vertically upward. At a predetermined height, the pressure is stabilized and the vacuum loading machine is positioned so that the opening 87 in top plate 69 is aligned above cone 61 of mounting assembly 31. At this point, the pneumatic or hydraulic pressure is increased and piston 101 moves into actuator 47 which in turn lowers mounting fixture 41 into a position where the cone 61 passes through opening 87. As the mounting fixture 41 continues to be lowered, cone 61 continues to guide mounting fixture 41 onto receiving bracket 39 until bracket 39 and fixture 41 are fully engaged as shown in FIG. 1.

Once the receiving bracket 39 and mounting fixture 41 are fully engaged, the separator 3 can be vertically and rotatably adjusted with respect to upper and lower pivoting ears 77, 79. As the hydraulic or pneumatic pressure which is applied to actuator 47 is increased, piston 101 will extend forcing arms 43, 45 to rotate about the upper and lower ears 77, 79 moving the separator 3 vertically upwardly and outwardly. As the hydraulic or pneumatic pressure is decreased, piston 101 is retracted within actuator 47 pulling arms 43, 45 down and correspondingly lowering separator 3. In the preferred embodiment, the vertical range of adjustment of the separator runs from a minimum clearance below the lower hopper 27 of about 42 inches to an upper clearance of 9 feet or more. This wide range of adjustment allows the separator 3 to be positioned above a dump truck, a drum, bags or any other suitable device into which it is desired to dump the collected debris. It is also important to note that as hole 87 slides down over cone 61, curved portion 89 of lower plate 71 conforms with and contacts tubal member 59. This allows the separator 3 to be pivoted about the longitudinal axis of tubal member 59 providing great flexibility in positioning the separator 3 relative to the vacuum truck 1.

Figure 6:
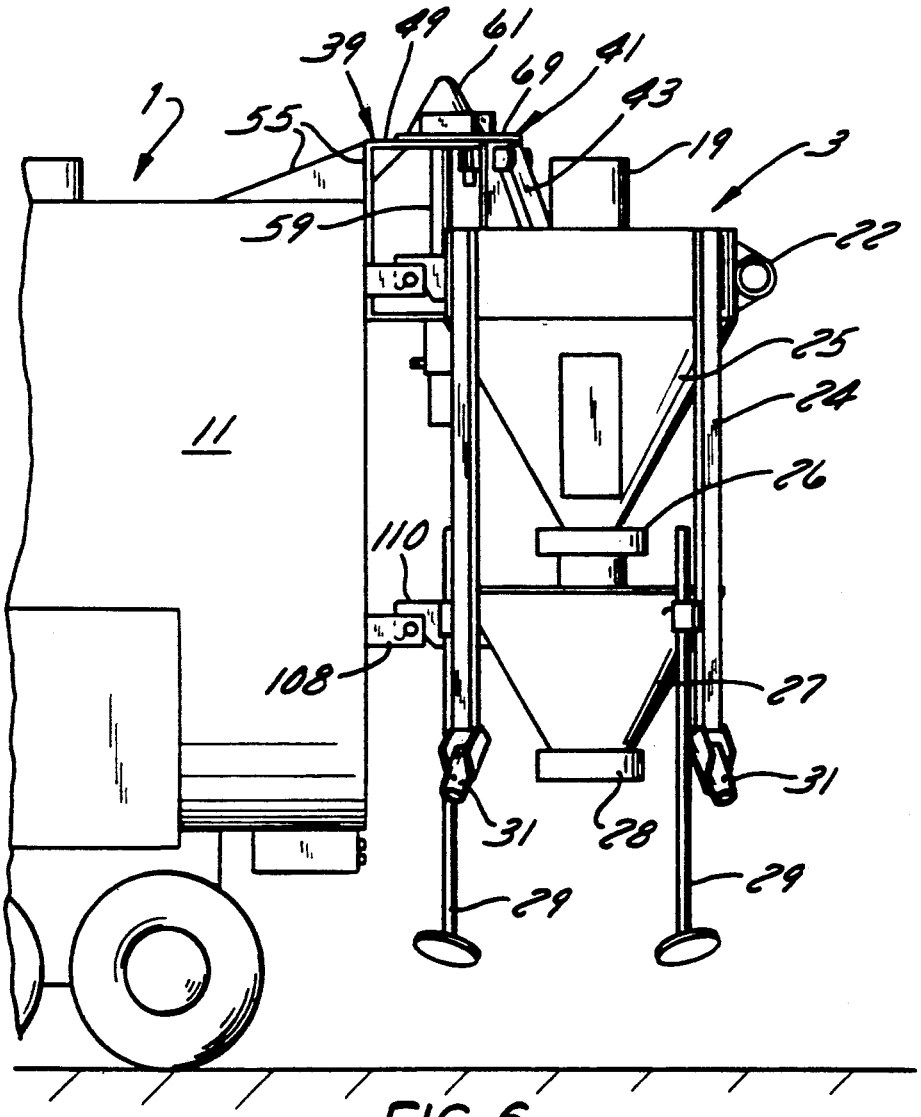
FIG. 6 is a side view of the coupled vacuum loading machine and separator being schematically displayed in a transport mode.

When the debris collection work is completed, the mounting fixture 41 can be disengaged from the receiving bracket 39, as shown in FIG. 2, and thus remotely stored. Conversely, the fixture 41 and bracket 39 can be left engaged and the separator raised off the ground so that it can be moved in close to the body 11 and transported with the vacuum machine as shown in FIG. 6. In this transport mode, pin 63 projects through hole 65 and engages one of the holes 85 locking the separator 3 in place to prevent lateral movement of the separator 3.

Also, as clearly shown in FIG. 4, a set of brackets 108 are provided on the back of loader 1 and another set of brackets 110 are affixed to separator 3, the brackets being arranged to engage one another when separator 3 is rotated into its transport position. In the illustrated embodiment, the separator brackets are really hooks adapted to be lowered over rods within the brackets 108. Other types of brackets or coupling systems could readily be substituted for the illustrated system.

Finally, a control unit 103 can be electrically connected to separator 3. The control unit 103 is used to control the hydraulic or pneumatic pressure supplied to the actuator 47. In addition, control unit 103 may include an alarm mounted to it which is activated when separator 3 approaches being filled with debris.

While a preferred embodiment of the invention has been described, it will be understood that it is capable of still further modifications, and this application is intended to cover any variations, uses, or adaptations of the invention, following in general the principles of the invention and including such departures from the present disclosure as would come within the knowledge or customary practice in the art to which the invention pertains, and as may be applied to the essential features hereinbefore set forth and falling within the scope of the invention or the limits of the appended claims. For example, it should be clear from the above-description that the separator unit could be used separate and apart from a vacuum unit mounted to a vehicle, and as long as hydraulic and electric power is furnished in some manner, the separator could be coupled to any available vacuum source.

What is claimed is:

1. A docking system for coupling and uncoupling separating equipment to a vacuum source the equipment having a separator adapted to remove particular matters from an air stream flowing through the separator toward the vacuum source, the separator having a house including a side wall, an inlet for particle laden air and an outlet for air from which particulate matter has been separated, comprising:

(a) a mounting fixture connected to the separator;

(b) a bracket for detachably receiving said mounting fixture, said bracket being connected to the vacuum source; and (c) means for moving said mounting fixture into engagement with and disengagement from said receiving bracket and means for moving said separator rotationally and vertically with respect to said bracket.

2. A docking system as claimed in claim 1. wherein said means for moving comprises a first arm pivotably connected at a first end to said mounting fixture and pivotably connected at a second end to said separator, and an actuator pivotably connected at one end to said first arm and pivotably connected at an opposite end to said mounting fixture.

3. A docking system as claimed in claim 2. wherein said actuator is a hydraulic actuator.

4. A docking system as claimed in claim 2, wherein said means for moving further comprises a second arm which is pivotably connected to both said mounting fixture and said separator.

5. A docking system as claimed in claim I, wherein said receiving bracket further comprises:

(a) an upper plate;

(a) a lower plate spaced apart from and parallel with said upper plate;

(c) a first tubal member connecting said upper plate to said lower plate.

6. A docking system as claimed in claim 5 wherein said upper plate has a spring loaded pin connected thereto, said pin being capable of extending through said hole.

7. A docking system as claimed in claim 5, wherein said receiving bracket further comprises a cone portion extending upwardly from said upper plate for guiding said mounting fixture onto said mounting assembly.

8. A docking system as claimed in claim 7, wherein said mounting fixture further comprises:

(a) a top plate having a circular opening;

(b) a bottom plate which is spaced apart from and parallel to said top plate; and (c) a second tubal member connecting said top and bottom plates.

9. A docking system as claimed in claim 8, wherein said bottom plate includes a curved notch.

10. A docking system as claimed in claim 8, wherein said top plate has at least one hole adjacent its perimeter.

11. A docking system as claimed in claim 8 further comprising means to rotate said mounting fixture about the axis of said first tubal member.

12. A docking system as claimed in claim 11 wherein said rotating means comprise a motor having a shaft and a gear coupled thereto and coupled to said mounting fixture, said gear meshing with a gear plate mounted to said receiving bracket when said system is in a fully engaged configuration.

13. A docking system for coupling and uncoupling separating equipment to a vacuum source the equipment having a separator adapted to remove particular matters from an air stream flowing through the separator toward the vacuum source, the separator having a housing including a side wall, an inlet for particle laden air and an outlet for air from which particulate matter has been separated, comprising:

(a) a mounting fixture connected to the separator;

(b) a receiving bracket for detachably receiving said mounting fixture, said receiving bracket being connected to the vacuum source; and (c) means for moving said mounting fixture into engagement with and disengagement from said receiving bracket and means for moving said separator rotationally and vertically with respect to said receiving bracket.

(d) a plurality of adjustable legs connected to said separator;

(e) a first flexible hose; and (f) a second flexible hose, wherein said separator has an inlet port and an exhaust port, said first flexible hose connected at one end to the vacuum source and at an opposite end to said exhaust port, said second flexible hose having a first and connected to said inlet port and a free end for vacuuming debris.

14. A mounting bracket, attachable to a vacuum source and which is coupleable to a mounting fixture that is attached to separating equipment, the equipment comprising a separator adapted to remove particular matters from an air stream flowing through the separator toward the vacuum source, the separator having a housing including a side wall, an inlet for particle laden air and an outlet for air from which particulate matter has been separated, comprising:

(a) an upper plate;

(b) a lower plate which is spaced apart from and is parallel to said upper plate;

(c) a tubular member connecting said upper plate to said lower plate; and (d) a cone extending upwardly from said upper plate.

15. An apparatus comprising:

a mobile frame;

a vacuum source including a housing mounted to the frame;

a separator for removing particular matters from an air stream passing through the separator toward the vacuum source, the separator having a housing including a side wall, an inlet for particle laden air and an outlet for air from which particulate matter has been separated, and the separator also including support legs;

a first coupler mechanically attached to the housing; and a second coupler mechanically attached to the separator and detachably coupled to the first coupler, where the separator is supported by the housing when the first and second couplers are coupled, and the separator is supported by the legs when the first and second couplers are detached, and further comprising an actuator means between the separator and the second coupler arranged to move the separator relative to the housing such that the separator is supported on the legs when the first and second couplers are detached.

16. The apparatus of claim 15 wherein the frame is a truck mounted frame.

17. The apparatus of claim 15, further comprising an actuator coupled between the separator and the second coupler, where the actuator is configured to move the separator relative to the housing such that the separator is supportable upon the support assembly and the first and second couplers are detachable.

18. The apparatus of claim 17, where the separator is a cyclone separator.

19. The apparatus of claim 17, where the separator includes a first hopper and a second hopper having a gate valve disposed for selectable communication between the first hopper and the second hopper.

20. A method for coupling and uncoupling separating equipment to a vacuum source, comprising the steps of:

(a) attaching a receiving bracket to a vacuum source;

(b) attaching a mounting fixture to a separator;

(c) providing means for vertically moving said fixture;

(d) lowering said fixture for engagement with said bracket; and (e) raising said fixture to disengage said fixture from said bracket.

21. A method as claimed in claim 20, wherein said means for vertically moving comprises a first arm pivotably connected at a first end to said mounting fixture and pivotably connected at a second end to said separator, and an actuator pivotably connected at one end to said first arm and pivotably connected at an opposite end to said mounting fixture.

22. A method as claimed in claim 20, wherein said bracket further comprises:

(a) an upper plate;

(b) a lower plate which is spaced apart from and parallel to said upper plate; and (c) a cone extending upwardly from said upper plate.

23. A method as claimed in claim 21, wherein said mounting fixture further comprises:

(a) a top plate;

(b) an opening in said top plate through which said cone extends during step (d) engaging said mounting fixture with said bracket;

(c) a bottom plate which is spaced apart from and parallel to said top plate; and (d) a second tubal member connecting said top and bottom plates.

* * * * *